US005307600A

United States Patent [19]

Simon, Jr. et al.

[11] Patent Number: 5,307,600

[45] Date of Patent: May 3, 1994

[54] SLIM WALL SYSTEM

[75] Inventors: Laurence J. Simon, Jr., Campbell; Timothy M. Hogan, Fremont, both of Calif.

[73] Assignee: Unistrut International Corp., Ann Arbor, Mich.

[21] Appl. No.: 894,499

[22] Filed: Jun. 4, 1992

[51] Int. Cl.[5] ..... E04H 1/00; E04B 1/343

[52] U.S. Cl. ..... 52/241; 52/100; 52/264; 52/293.3

[58] Field of Search ..... 52/235, 241, 243, 98, 52/36, 710, 100, 293, 264, 293.3, 241, 100

[56] References Cited

U.S. PATENT DOCUMENTS

| | | | |
|---|---|---|---|
| 1,511,764 | 10/1924 | Jordahl | 52/710 |
| 2,979,788 | 4/1961 | Richardson | 52/98 |
| 3,034,609 | 5/1962 | Young . | |
| 3,043,408 | 7/1962 | Attwood . | |
| 3,075,621 | 1/1963 | Attwood . | |
| 3,193,061 | 7/1965 | Downes . | |
| 3,256,668 | 6/1966 | Downes . | |
| 3,397,495 | 8/1968 | Thompson et al. . | |
| 3,583,116 | 6/1971 | LaGue . | |
| 3,593,475 | 7/1971 | LaGue . | |
| 3,601,347 | 8/1971 | Attwood . | |
| 3,807,112 | 4/1974 | Perina . | |
| 3,859,765 | 1/1975 | Nelsson . | |
| 3,863,412 | 2/1975 | Bodycomb et al. . | |
| 3,982,370 | 9/1976 | Buffington . | |
| 4,110,942 | 9/1978 | Slocomb, Jr. | 52/100 |
| 4,163,350 | 8/1979 | Doguchi et al. | 52/241 |
| 4,688,750 | 8/1987 | Teague et al. | 52/36 |
| 4,984,400 | 1/1991 | Bockmiller . | |

FOREIGN PATENT DOCUMENTS

| | | | |
|---|---|---|---|
| 650239 | 2/1951 | United Kingdom | 52/710 |

*Primary Examiner*—Carl D. Friedman
*Assistant Examiner*—Christopher Kent
*Attorney, Agent, or Firm*—Dykema Gossett

[57] ABSTRACT

A non-progressive modular partition wall assembly has particular advantages for use in a clean room. The assembly includes several basic elongated framing members which may be modified for a variety of uses. The modular partition wall assembly may be constructed into different orientations and with different types of wall systems. Modifications are possible without major wall reconstruction. The framing members include an open channel with receptor arms for receiving mounting means such as nut and bolt combinations. A disclosed framing member has both an open and a closed face, and a fence extending outwardly from an outer surface of the closed face. The fence and outer surface define a sill to receive an edge of a panel. The fence may be removed if full facial contact between the inner surface of the panel and outer surface of the closed face of the framing member is desired. Various retainers may be used to secure a panel to a framing member. The inventive assembly may be constructed into numerous configurations with minimal components. Further, the inventive assembly is easily serviced and reconstructed.

12 Claims, 5 Drawing Sheets

SLIM WALL SYSTEM

BACKGROUND OF THE INVENTION

This invention relates to a non-progressive wall assembly which may be used as a clean room, and in particular to an assembly constructed from a limited number of distinct framing members which may be modified for use in different orientations and with different wall structures.

There is an increasing need for cleaner environments in which laboratory procedures and high technology component production may be undertaken. The configuration and mechanical requirements for such rooms vary widely. To meet the varying requirements, a variety of wall systems may be constructed. Various wall panels are typically used, including a hollow double or utility wall, a full or solid modular wall, and a single or chase wall. A particular wall assembly may include one or more of these systems which are customized for the particular application. As a result, most clean room assemblies are expensive custom made constructions. Besides taking up a large amount of space in an existing room, any later alterations or additions require expensive retrofitting or reconstruction.

SUMMARY OF THE INVENTION

The present invention discloses a system which facilitates the construction of a wide number of clean room assemblies from a limited variety of framing members. Wall systems which may be made under the present invention are easily tailored to combine double wall, full modular wall, and chase wall panels. The framing members are designed to minimize wasted space. Further, easy access to the interior of each wall assembly is provided, and modifications to the wall systems may be made without expensive reconstruction or retrofitting.

The present invention includes an extruded aluminum elongated polygonal framing member with an open face and at least one closed face. The open face defines a channel with receptor arms for receiving mounting means such as a nut and bolt combination. The mounting means are typically used to join framing members together, although the mounting means may also retain panels. The closed face includes at least one and preferably two fences extending outwardly from an outer surface of the closed face. The fences are preferably formed on opposing sides of a slot running along the framing member. The fences and outer surface define a sill which may receive a panel. A retainer may be secured to the framing member using a screw passing through an aperture in the retainer and threadingly engaging the slot. The retainer assists in holding the panel. Preferably, the present invention includes three types of retainers. In addition to a standard retainer, a second retainer may be used as an outer corner piece and a third retainer as an inner corner piece. A retainer cover snaps into a central portion of each retainer.

Under some circumstances the fences may not be necessary to support a sill, and thus become an obstruction. The fences are preferably easily removed from the closed face without creating undesirable contaminants. The removable fences are thus one important feature in providing versatility in modifying the final wall systems. To construct the maximum number of wall combinations it is preferable to use both a generally U-shaped framing member and a generally I-shaped framing member. The primary difference between the two embodiments is that the I-shaped framing member has two closed and two open faces whereas the U-shaped framing member has only one closed and one open face.

The present invention also includes an elongated polygonal framing member which is generally U-shaped, and has two flanges connected by a lower web portion. Preferably, two such framing members are used where an upper portion of one set of flanges is longer than the other. Such framing members may also be used as a terminal end piece.

The above-described framing members can be combined into any number arrangements such that a room can be easily tailored to a desired configuration. The framing members may be used in either a vertical or horizontal orientation.

DETAILED DISCLOSURE OF A PREFERRED EMBODIMENT

Figure 1:
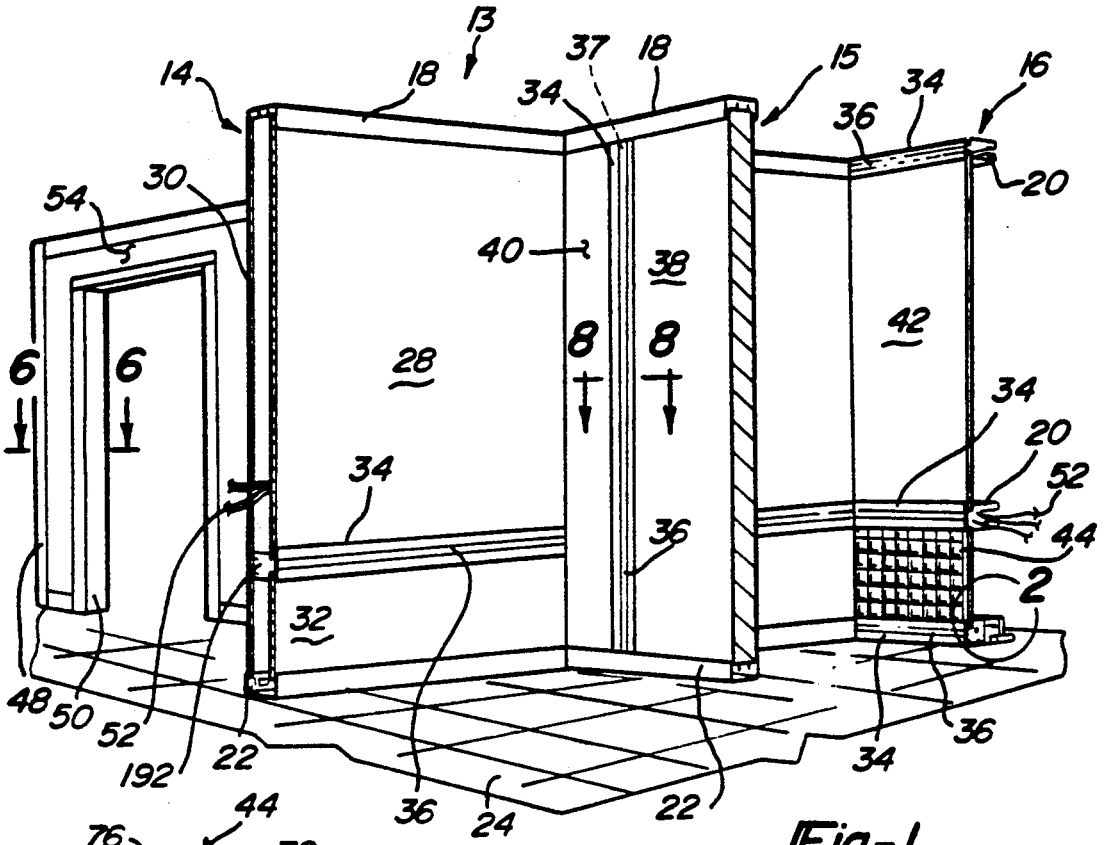
FIG. 1 is a perspective view of one configuration of the partition wall assembly according to the present invention.

FIG. 1 illustrates a non-progressive partition wall assembly 13 which includes a utility wall 14, a full modular wall 15, and a chase wall 16. Utility wall 14 has a first framing member 18, a second framing member 192 and a third framing member 22. It should be understood that partition wall assembly 13 is merely one illustrated configuration. In fact a main feature of the present invention is the versatility in creating various wall assembly configurations from a limited number of distinct components. Partition wall assembly 13 as illustrated is thus an attempt to show numerous possible wall panel configurations.

Framing members 18, 20, 22, and 192 are preferably extruded aluminum. Framing member 22 is preferably secured to floor 24. Utility wall 14 includes panels 28, 30 and 32. Panel 28 is disposed between framing member 18 and framing member 192. Panel 30 is disposed between framing member 18 and framing member 22 and is in facial contact with an outer surface of framing member 192. Panel 32 is disposed between framing member 192 and framing member 22. Panels 28 and 32 are secured to framing member 192 through the use of a retainer 34 as described further below. A retainer cover 36 is also shown.

Framing members 18 and 22 may also be used with full modular wall 15. Full modular wall 15 may include two full modular panels 38 and 40 disposed between framing member 18 and framing member 22 and separated by a framing member 37 acting as a vertical stud. Retainer 34 is used in conjunction with vertical studs to retain panels 38 and 40.

Chase wall 16 illustrates the use of three framing members 20. Panels 42 and 44 are disposed between framing members 20 and have one framing member 20 in common. Retainer 34 is used in conjunction with framing members 20 to retain panels 42 and 44.

Panel 44 is distinguishable from panel 42 in that panel 44 has apertures while panel 42 is solid. A panel used in the construction of partition wall assembly 13 may be constructed from any number of materials including glass or plastic. The panels may also be solid or interposed with a number of apertures. Yet, interchangeability of panels is possible without special components using selected ones of the inventive framing members. Thus, a damaged panel may be replaced, or entirely new panels may be added. In the case of utility wall 14, panels are removable from both sides. Even when a panel is not replaced, simple panel movement promotes access to the interior of partition wall assembly 13. This is particularly important when utilities 52 are installed in the cavity between panels.

Partition wall assembly 13 also includes a framing member 48 acting as a terminal end detail and a door frame assembly 50. This provides closure for panel 54 which may be used in conjunction with framing members 18 and 22. Finishing is thus generally provided by the exposed panel closure trim and includes the framing members, retainers and retainer covers. Preferably, the trim of framing members is flush with the trim of abutting framing members, their retainers and retainer covers. Framing member 18 as shown in FIG. 1 also helps to prevent turbulent air flow over a panel.

Utility wall 14, full modular wall 15, and chase wall 16 are preferably dimensioned to provide walls of approximately equal width, and most preferably two inches wide. The narrow width reduces wasted space. Further, this width fits common air filter ceiling systems. A consistent width means that fewer types of framing and mounting members are required. As a result, the same framing or mounting member may be used inmore than one application. Further, interchangeability permits partition wall assembly modifications to be accomplished without major wall reconstruction, saving both labor and material costs. For example, framing members 18 and 22 may both be used with utility wall 14 and with full modular wall 15 as shown in FIG. 1. This is possible due to their common width. Additionally, as discussed further below, framing member 48 is interchangeable with framing members 18 and 22 when used as a terminal end piece. Framing members also are used to serve more than one function. For example, it may be desirable to install utilities 52 within the framing member itself, as shown with respect to framing member 20, particularly when utility wall 14 is not being used.

Figure 2:
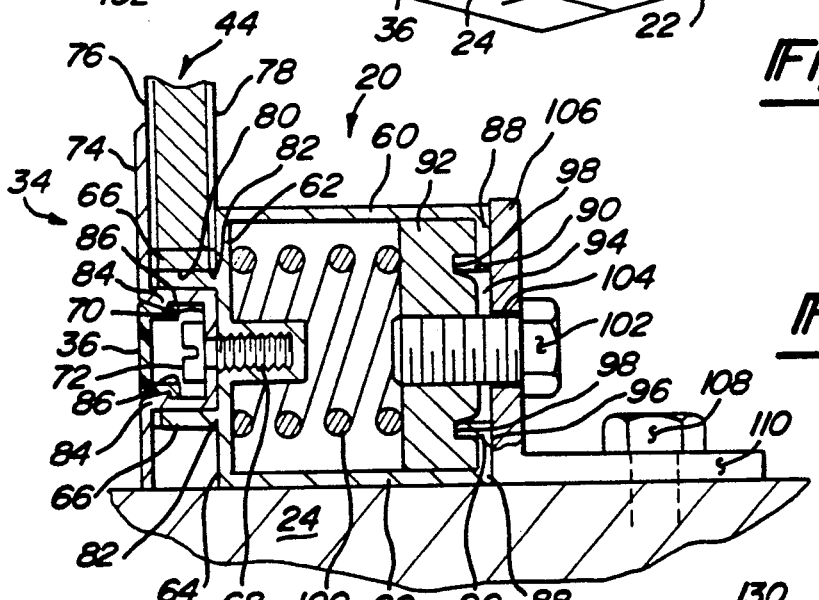
FIG. 2 is an enlarged end view of the area indicated by the circle 2 in FIG. 1.

FIG. 2 illustrates the securement of panel 44 to framing member 20 in greater detail. Framing member 20 includes two flanges 60 connected by a lower web portion or closed face 62 with an outer surface 64. A pair of fences 66 extend outwardly from outer surface 64. Fences 66 are disposed on opposing sides of a slot 68, which has screw threads. Retainer 34 includes a central portion 70. A screw 72 passes through an aperture in central portion 70 to threadingly engage slot 68. No drilling in the assembly area is required. This feature is particularly important with clean room construction. Further, screw 72 is removable and reinstallable at any location along slot 68. Retainer 34 includes a projection 74 extending laterally outward from central portion 70 to engage an outer surface 76 of panel 44. A lower edge portion of panel 44 is received in a sill formed by outer surface 64 and fence 66. It is preferred that outer surface 64 and fence 66 have flat surfaces and be at right angles to each other. This arrangement permits nearly full facial contact between inner surface 78 of panel 44 and outer surface 64, and between bottom edge 80 of panel 44 and fence 66. The use of a fence such as fence 66 allows a panel to rest in firm contact with a framing member. Central portion 70 of retainer 34 provides additional support beneath fence 66. Contact with fence 66 is not necessarily required and may not even be desirable in certain situations. For example, when a framing member is used as a vertical stud, the position of fence 66 and the length of projection 74 permits a tolerance when cutting a panel. The panel is adequately secured although not necessarily in contact with fence 66. In such a situation, fences 66 provide additional support and rigidity to retainer 34.

Fence 66 is often a critical element of a framing member, particularly when used in an application similar to that illustrated in FIG. 2. Under certain circumstances, however, fence 66 may be unnecessary. To aid in its removal, a notch 82 is formed at an edge of fence 66 and outer surface 64. Preferably, notch 82 is along an outer edge as illustrated in FIG. 2. Fence 66 can be snapped off at notch 82. The ability to easily remove fence 66 provides additional flexibility so that a single framing member can be used under a variety of circumstances with or without fences 66. This provides additional versatility such that partition wall assembly modifications may be accomplished without major wall reconstruction, without the generation of undesirable contaminants, and with a minimum number of components.

Retainer cover 36 is snapped into central portion 70 of retainer 34. Central portion 70 includes a pair of mounting ribs 84. Retainer cover 36 includes a pair of snap-on ribs 86 which are spaced apart a greater distance than the corresponding inner surfaces of the outer edge portion of mounting ribs 84. This creates an interference that holds retainer cover 36 in place. Retainer cover 36 is preferably made of a yieldable material. Vinyl is generally preferred, but other materials such as aluminum may be used.

FIG. 2 also illustrates one method for mounting a framing member, in this case framing member 20, to another object. Framing member 20 includes receptor arms 88 extending laterally inwardly from a free end of flanges 60. Each receptor arm 88 includes an in-turned tab 90. A nut 92 received in channel 94 of open face 96 of framing member 20 includes two grooves on an outward facing side which engage in-turned tabs 90 of receptor arms 88. A spring 100 maintains nut 92 in a proper orientation so that a bolt 102 can pass through an aperture 104 of an L-bracket 106 to threadingly engaged nut 92. Nut 92 may be moved along channel 94 to a desired location. Bolt 108 passes through an aperture formed in leg 110 of L-bracket 106 to engage floor 24.

Each framing member preferably has a similar channel and receptor arm arrangement which permits the framing member to be mounted in a wide variety of ways. Framing members 18, 20, and 22 may also be attached to framing members acting as vertical studs using the method illustrated in FIG. 2. Due to this inventive mounting arrangement, assembly modifications may also be made without major reconstruction. For example, it is not difficult to later add a horizontally extending framing member between vertical studs to carry utilities while simultaneously providing additional load bearing support.

Figure 3:
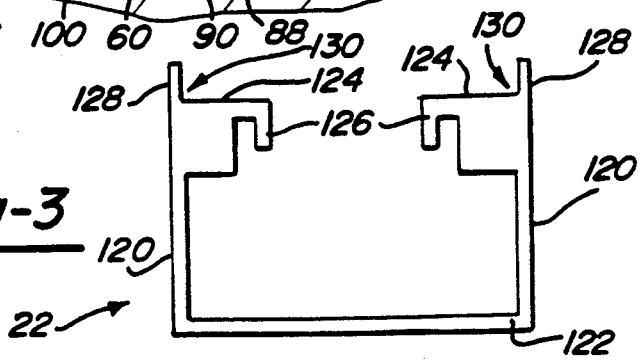
FIG. 3 is an end view of a first framing member according to the present invention.

FIG. 3 illustrates framing member 22, which is generally U-shaped with two flanges 120 connected by a lower web portion 122. Each flange 120 extends outwardly of web portion 122 with a panel support base 124 extending laterally inwardly of each flange 120. Panel support base 124 includes a receptor arm 126 similar to that discussed above with respect to framing member 20. Panel support base 124 and upper portion 128 of flange 120 define a shelf 130. When used with utility wall 14 a different panel is received within each shelf 130. When used with full modular wall 15, however, a single panel is received within both shelves 130.

Figure 4:
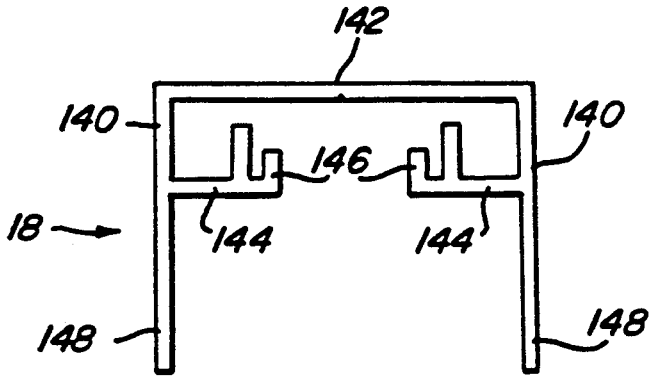
FIG. 4 is an end view of a second framing member according to the present invention.

FIG. 4 illustrates framing member 18, which is generally U-shaped, with two flanges 140 connected by a lower web portion 142. Each flange 140 extends outwardly of web portion 142 with a panel support base 144 extending laterally inwardly of each flange 140. Panel support base 144 includes a receptor arm 146, and is thinner than panel support base 124 of FIG. 3. Thus, less material is extruded. Another difference between framing members 22 and 18, however, is that upper portion 148 of flange 140 extends a greater distance than upper portion 128 of flange 120. The importance of these two distances is shown in FIG. 5.

Figure 5:
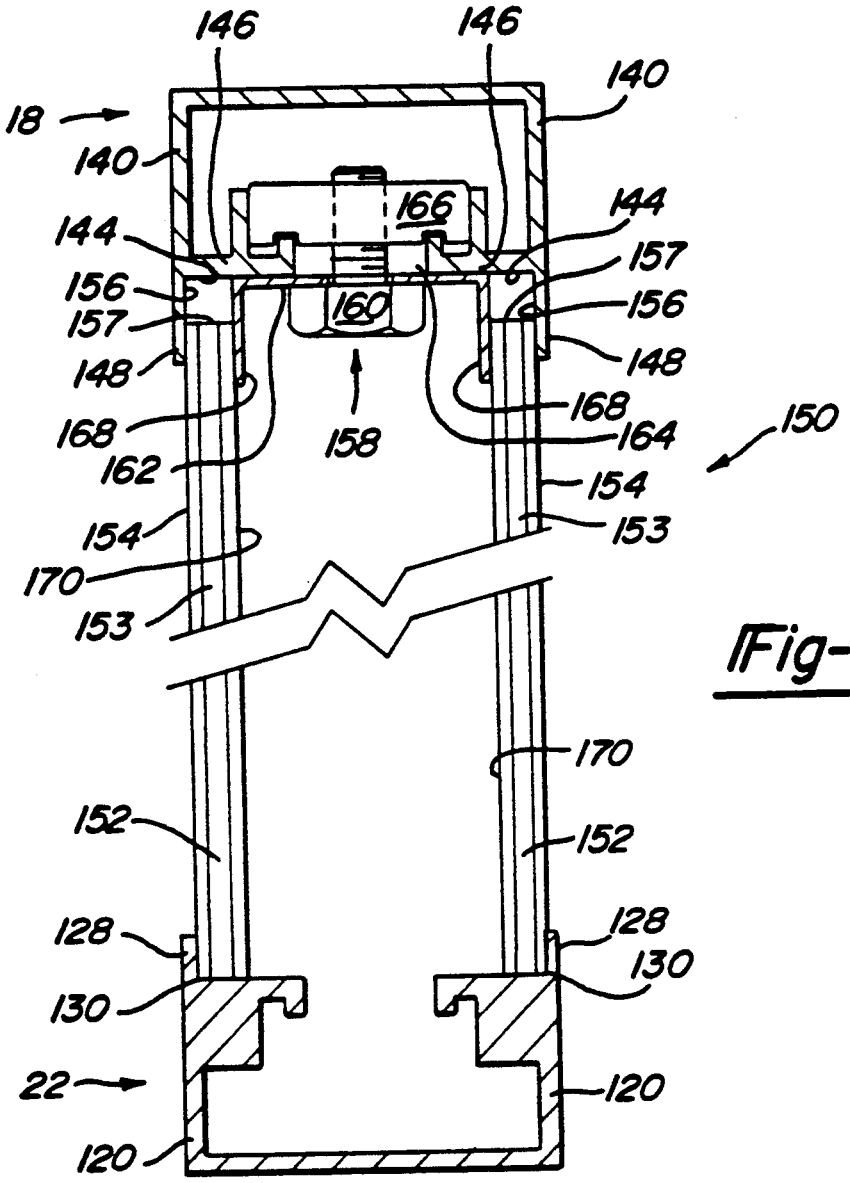
FIG. 5 is a cross-sectional view of a utility wall sub-assembly according to an embodiment of the present invention.

FIG. 5 illustrates a cross-section of a partition wall sub-assembly 150. A lower edge portion 152 of a panel 153 is received in a shelf 130 of framing member 22 and in facial contact with upper portion 128 of flange 120. An outer surface 154 of panel 153 is in facial contact with an inner surface 156 of upper portion 148 of flange 140 of framing member 18. To remove panel 153 from partition wall assembly 150, panel 153 is merely moved upwardly until the top edge 157 contacts panel support base 144. At this point, lower edge portion 152 of panel 153 clears upper portion 128 of flange 120 of framing member 22 allowing panel 153 to be pivoted outwardly and removed.

In general, framing members acting as vertical studs assist in maintaining panels 153 in a proper orientation. Under some circumstances, however, it may be desirable to use mounting means 158 in order to maintain panels 153 in a proper orientation. FIG. 5 illustrates the use of a bolt 160 passing rthrough a bracket 162 into channel 164 of framing member 18 to threadingly engage nut 166. Nut 166 is in facial contact with receptor arms 146. The outer surface of flanges 168 of bracket 162 are in facial contact with the inner surface 170 of panels 153. While one such use of an open facial channel to retain a panel is disclosed, it should be understood that many variations are possible.

Figure 6:
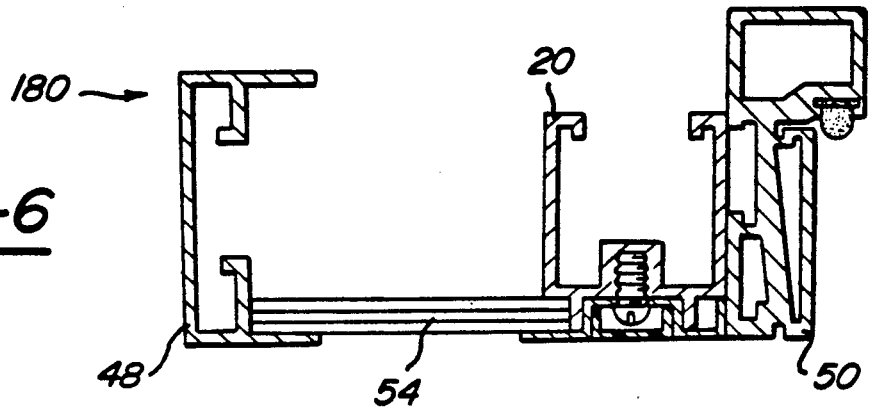
FIG. 6 is cross-sectional view along lines 6—6 in FIG. 1.

FIG. 6 illustrates a sub-assembly 180 of partition wall assembly 13. Framing member 48 acts as a terminal end detail. In essence, framing member 48 is another embodiment of framing members 18 and 22 and either one of these could act as a terminal end detail in place of framing member 48. FIG. 6 also illustrates the use of framing member 20 as a vertical stud for panel 54. Panel 54 is secured to framing member 20 in the manner discussed above. Door frame assembly 50 is attached to framing member 20 through the use of a simple attachment device such as a screw (not shown). Door frame assembly 50 may be attached to any framing member.

Figure 7:
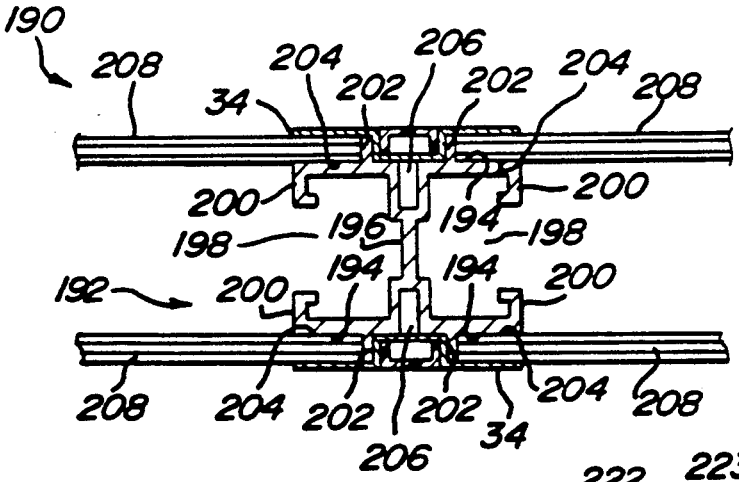
FIG. 7 is a cross-sectional view illustrating a third framing member according to the present invention in conjunction with a utility wall sub-assembly.

FIG. 7 illustrates a partition wall sub-assembly 190 which includes framing member 192. Framing member 192 includes two closed faces 194 connected by a wedge portion 196 extending between them. Framing member 192 has two open faced channels 198 with receptor arms 200. A pair of fences 202 extend perpendicularly from an outer surface 204 of each closed face 194 and are disposed on opposing sides of a slot 206. Panels 208 are disposed in a sill formed by a fence 202 and outer surface 204. Panels 208 are secured to framing member 192 in the manner discussed above with respect to framing member 20. Sub-assembly 190, including framing member 192, may be used in either a vertical or a horizontal orientation.

Figure 8:
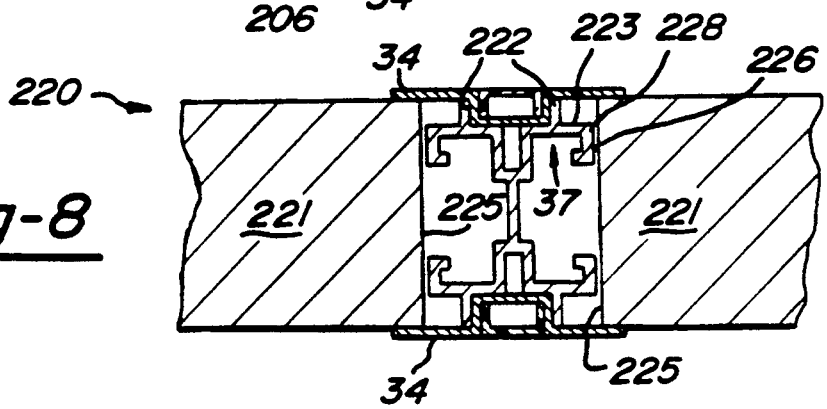
FIG. 8 is a cross-sectional view along lines 8—8 in FIG. 1 illustrating a fourth framing member in conjunction with a full modular wall sub-assembly.

FIG. 8 illustrates a wall partition sub-assembly 220 which includes framing member 37 in conjuntion with full modular panels 221. In this particular application, a panel 221 is not disposed within the sill formed by fence 222 and outer surface 223 of closed face 224. Instead an edge 225 of panel 221 may be in facial contact with outer surface 226 of receptor arm 228 Retainer 34 is used in a manner similar to that discussed above with respect to FIG. 2 to maintain full modular panels 221 in a proper orientation with respect to framing member 37. Sub-assembly 220, including framing member 37, may be in either a vertical or a horizontal orientation. Framing member 37 may be used in place of framing member 192. The essential difference between the two is that framing member 192 may be preferred with non-full modular panels because it has a larger outer surface which provides a better seal and panel cutting tolerance. Yet, less facial contact would result between retainer 34 and panel 221 if framing member 192 were used in place of framing member 37 in the application shown in FIG. 8.

Figure 9:
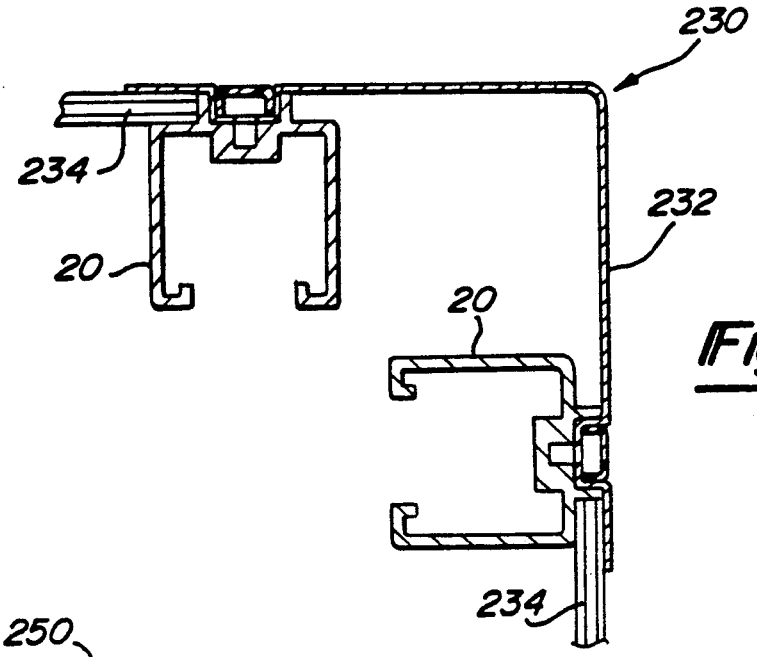
FIG. 9 is a chase wall sub-assembly with a retainer serving as an outer corner member.

FIG. 9 illustrates a wall partition sub-assembly 230. Framing members 20 are used as vertical studs with a single retainer 232 disposed between them. Retainer 232 acts as an outer corner member while stil retaining panels 234 is conjunction with framing members 20.

Figure 10:
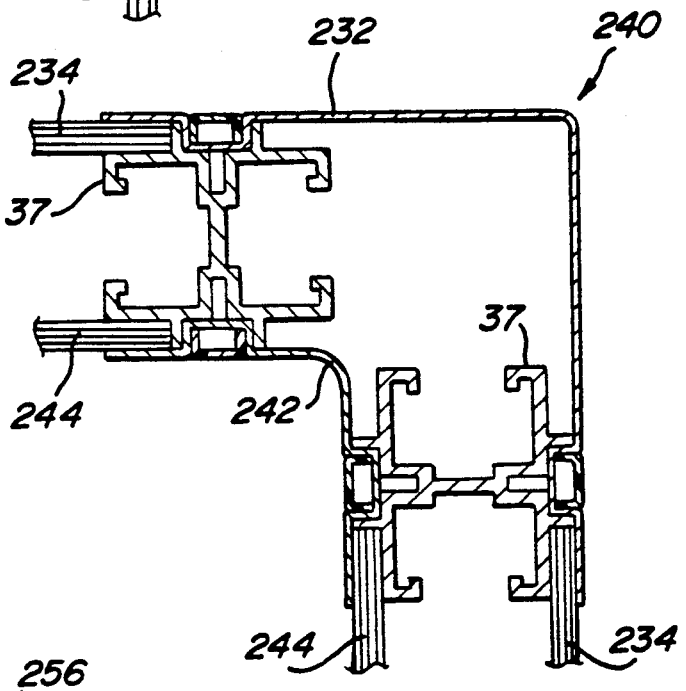
FIG. 10 is a utility wall assembly with the retainer of FIG. 9 serving as an outer corner member and another retainer serving as an inner corner member.

FIG. 10 illustrates a wall partition sub-assembly 240 which is a corner section of a utility wall system. Because of the double wall nature of sub-assembly 240, framing members 37 are used instead of framing members 20. Retainer 232 functions in the manner discussed with respect to FIG. 9. Retainer 242 serves an inner corner member while simultaneously retaining panels 244 in conjunction with framing members 37. For this particular application, framing member 192 could be used in place of framing member 37.

Figure 11:
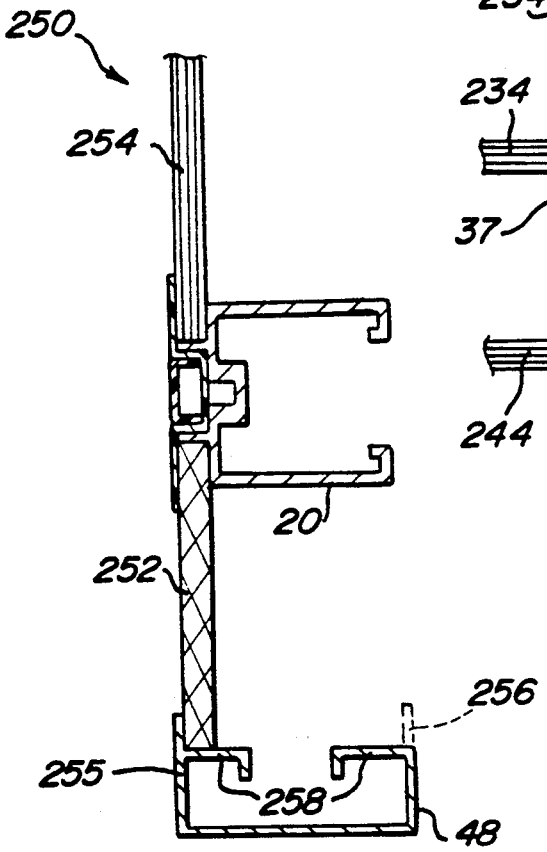
FIG. 11 is a cross-section of a chase wall sub-assembly according to an embodiment of the present invention.

FIG. 11 illustrates a wall partition sub-assembly 250 which is a portion of a chase wall system. Framing member 20 is used in a horizontal fashion to separate and secure panels 252 and 254. Panel 252 is constructed differently than panel 254. FIG. 11 also shows the use of framing member 48 as a lower framing member. Alternatively, framing member 18 or 22 may also be used. Additionally, a framing member such as framing member 48 might be used in place of framing member 20 in conjunction with retainer 34 and retainer cover 36 when a smooth lower outer surface 255 is preferred. When a framing member such as framing member 48 is used, however, upper flange portion 256 might need to be removed so that the bottom edge of a vertical stud member (not shown) may be set flush with panel support base 258.

Figure 12:
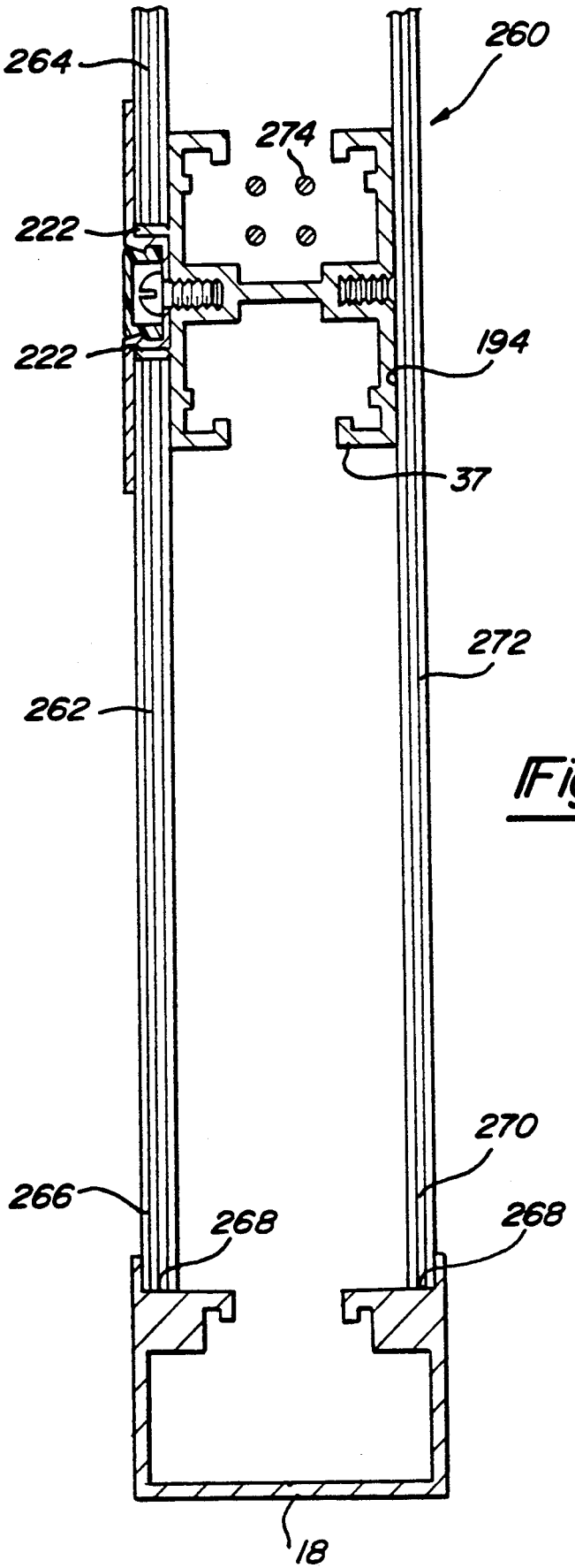
FIG. 12 is a cross-section of a utility wall sub-assembly according to an embodiment of the present invention.

FIG. 12 illustrates a sub-assembly 260 which is a portion of a utility wall system. Framing member 37 may be used to separate and retain panels 262 and 264. The lower edge portion 266 of panel 262 is disposed within a shelf 268 of framing member 18. Fences 222 have been removed from the right side closed face 194 framing member 37 so that panel 272 may extend past framing member 37, such that lower edge portion 270 of panel 272 may be disposed within the second shelf 268 of framing member 18. FIG. 12 also illustrates the use of framing member 37 to carry utilities 274 within sub-assembly 260. For this particular application, framing member 192 could be used in place of framing member 37.

In summary, an inventive system has been disclosed wherein a minimal number of framing members can be modified into any number of configurations to support various combinations of wall panels. Framing members 18, 22, and 48 exemplify one type of framing member. Its use is illustrated with respect to utility wall 14 or full modular wall 15 and as a terminal end piece, a ceiling framing member, or as a floor framing member. A second type of framing member is illustrated by framing members 20, 37, and 192 in conjunction with utility wall 14, full modular wall 15, and chase wall 16. Its use as a vertical stud and horizontal panel divider has been shown. All of framing members have compatible dimensions and it is relatively easy to modify existing room structures. Framing members are easily interchanged, without changing the dimensions of a particular wall. Further, features of the present inventive framing members, such as the removable fences allow each of the framing members to be utilized to perform several functions in the inventive system. Thus, only a limited number of framing members must be stocked and manufactured to provide sufficient versatility in the manufacture of wall systems.

Several preferred embodiments of the present invention have been disclosed. A worker of ordinary skill in the art would realize, however, that certain modifications would come within the teaching of this invention. Thus, the following claims should be studied in order to determine the true scope and content of the invention.

We claim:

1. A polygonal elongated framing member for supporting at least one wall panel having an edge portion comprising:

an open face defining an open channel with edges extending substantially along the entire length of said framing member for receiving a mounting means;

a closed face opposite said open face having an outer surface;

at least one fence extending perpendicularly outwardly from said outer surface of said closed face, said fence and said outer surface of said closed face defining an intersection and a sill for receiving an edge portion of a wall panel;

a notch formed within said sill at the intersection of said fence and said outer surface of said closed face, said notch allowing selective separation of said fence from said outer surface of said closed face; and wherein said open face is defined by a pair of projections extending laterally inwardly from the edges of said channel.

2. A polygonal elongated member as recited in claim 1, wherein said closed face includes a slot for receiving securement means extending inwardly of said outer surface of said closed face and a pair of said at least one fence disposed on opposing sides of said slot.

3. A polygonal elongated member as recited in claim 1, wherein an in-turned tab extends from a free end of said projection, said projection and in-turned tab acting as a receptor arm for receiving a portion of said mounting means.

4. A partition wall assembly comprising:

a polygonal elongated framing member with an open face defining an open channel having edges for receiving mounting means and a closed face having an outer surface with at least one fence extending outwardly from said outer surface of said closed face wherein said open face defining an open channel extends substantially along the entire length of said framing member for receiving a mounting means, said fence and said outer surface of said closed face defining an intersection and a sill, a notch formed within said sill at the intersection of said fence and said outer surface of said closed face, said notch allowing selective separation of said fence from said outer surface of said closed face, wherein said open face is defined by a pair of projections extending laterally inwardly from edges of said channel; and a panel received in said sill defined by said fence, said panel having an inner surface, said inner surface of said panel being in facial contact with said outer surface of said closed face of said framing member.

5. A partition wall assembly as recited in claim 4, wherein an edge of said panel contacts said fence.

6. A partition wall assembly as recited in claim 4, wherein said closed face of said framing member includes a slot extending inwardly of said outer surface of said closed face and a pair of said at least one fence disposed on opposing sides of said slot, a retainer with a central portion disposed between said at least one fence and securement means passing through an aperture formed in said central portion of said retainer to engage said slot, said retainer including a projection extending laterally outwardly of said central portion and engaged with an outer surface of said panel.

7. A partition wall assembly as recited in claim 6, wherein said framing member is generally I-shaped with a first and second closed face connected by a wedge portion extending therebetween, said panel being received in a sill formed on said first said closed face and being retained by said retainer.

8. A partition wall assembly for building at least a portion of a new room comprising:

elongated framing members positioned to form a structural framework, including a polygonal framing member having an open face defining a channel having spaced edges for receiving a mounting means and a closed face having an outer surface with a slot for receiving a securement means extending inwardly of said outer surface of said closed face, a pair of fences disposed on opposing sides of said slot and extending outwardly from said outer surface of said closed face, each said fence and said outer surface of said closed face defining a sill, said open face including a projection extending laterally inwardly of each said edge of said channel with an in-turned tab at the free end of each said projection, each said projection and each in-turned tab acting as a receptor arm for receiving a portion of said mounting means;

wherein said open face defining an open channel extending substantially along the entire length of said framing member for receiving a mounting means, each of said fences and said outer surface of said closed face defining a sill, a notch formed within said sills at the intersection of said fence and said outer surface of said closed face, each said notch allowing selective separation of said fence from said outer surface of said closed face, wherein said open face is defined by a pair of projections extending laterally inwardly from said edges of said channel;

a wall panel having an edge portion received in one of said sills; and a retainer with a central portion disposed between said fences of said polygonal framing member and a securement means passing through an aperture formed in said central portion of said retainer to engage said slot, said retainer including a projection extending laterally outwardly of said central portion and aligned with an outer surface of said panel.

9. A partition wall assembly as recited in claim 8, wherein said elongated framing members include a generally U-shaped elongated framing member with two flanges connected by a lower web portion, each said flange extending outwardly of said web portion with a wall panel support base extending laterally inwardly of each said flange, each said wall panel support base and an upper portion of each said flange defining a shelf, an in-turned tab being formed at the laterally inner portion of each said wall panel support base, each said in-turned tab acting as a receptor arm for receiving a portion of said mounting means, an outer surface of said panel being in facial contact with an inner surface of at least one said flange.

10. A partition wall assembly as recited in claim 8, wherein said polygonal framing member is generally I-shaped with a first and second closed face connected by a wedge portion extending therebetween.

11. A partition wall assembly as recited in claim 8, wherein said polygonal framing member is generally U-shaped and having two flanges being connected by said closed face.

12. A partition wall assembly as recited in claim 8, wherein said portion of said mounting means includes a nut received in said channel, said nut having grooves on an outward facing side and being engaged with said receptor arms.

* * * * *